US010996005B2

(12) United States Patent
Gotterbarm et al.

(10) Patent No.: US 10,996,005 B2
(45) Date of Patent: May 4, 2021

(54) HEAT EXCHANGER TUBE

(71) Applicant: WIELAND-WERKE AG, Ulm (DE)

(72) Inventors: Achim Gotterbarm, Dornstadt (DE); Ronald Lutz, Blaubeuren (DE); Jean El Hajal, Ulm (DE); Manfred Knab, Dornstadt (DE)

(73) Assignee: WIELAND-WERKE AG, Ulm (DE)

( * ) Notice: Subject to any disclaimer, the term of this patent is extended or adjusted under 35 U.S.C. 154(b) by 162 days.

(21) Appl. No.: 16/099,490

(22) PCT Filed: May 17, 2017

(86) PCT No.: PCT/EP2017/000595
§ 371 (c)(1),
(2) Date: Nov. 7, 2018

(87) PCT Pub. No.: WO2017/207089
PCT Pub. Date: Dec. 7, 2017

(65) Prior Publication Data

US 2019/0120567 A1 Apr. 25, 2019

(30) Foreign Application Priority Data

Jun. 1, 2016 (DE) ..... 10 2016 006 914.7

(51) Int. Cl.
*F28F 1/14* (2006.01)
*F28F 1/18* (2006.01)
(Continued)

(52) U.S. Cl.
CPC ..... *F28F 1/18* (2013.01); *F28F 1/36* (2013.01); *F28F 1/40* (2013.01); *F28F 1/422* (2013.01)

(58) Field of Classification Search
CPC ..... F28F 1/18; F28F 1/36; F28F 1/40; F28F 1/422
(Continued)

(56) References Cited

U.S. PATENT DOCUMENTS 1,951,394 A * 3/1934 Chase ..... H02G 3/0468 138/121
3,662,582 A * 5/1972 French ..... F28F 1/42 72/370.17
(Continued)

FOREIGN PATENT DOCUMENTS

DE 28 08 080 A1 8/1978
DE 27 58 526 C2 7/1979
(Continued)

OTHER PUBLICATIONS

International Search Report issued in Application No. PCT/EP2017/000595 with English translation dated Oct. 18, 2017 (9 pages).
(Continued)

*Primary Examiner* — Claire E Rojohn, III
(74) *Attorney, Agent, or Firm* — Flynn Thiel, P.C.

(57) ABSTRACT

The invention relates to a heat exchanger tube having a tube longitudinal axis, wherein fins extend continuously from the tube wall on the tube outer face and/or the tube inner face, or extend axially parallel thereto or in the form of a helix. Continuously extending primary grooves are formed between adjacent fins, said fins have at least one structured area on the tube outer face and/or tube inner face, and the structured area has a plurality of projections of a projection height projecting from the surface, the projections being separated by notches. According to the invention, a plurality of projections are deformed relative one another in pairs to such an extent that cavities are formed between adjacent projections. Furthermore, according to the invention, a plurality of projections are deformed in the direction of the tube
(Continued)

wall such that cavities are formed between a respective projection and the tube wall.

8 Claims, 3 Drawing Sheets

(51) Int. Cl.
*F28F 1/40* (2006.01)
*F28F 1/42* (2006.01)
*F28F 1/36* (2006.01)

(58) Field of Classification Search
USPC ..... 165/184
See application file for complete search history.

(56) References Cited

U.S. PATENT DOCUMENTS 3,696,861 A * 10/1972 Webb ..... F22B 37/101 165/133
3,776,018 A * 12/1973 French ..... F28F 1/02 72/370.17
4,179,911 A * 12/1979 Saier ..... B21C 37/207 165/184
4,216,826 A * 8/1980 Fujikake ..... B21C 37/205 165/133
4,332,069 A * 6/1982 Kritzer ..... B21C 37/20 72/325
4,476,704 A * 10/1984 Hage ..... B21C 37/20 72/276
4,577,381 A * 3/1986 Sato ..... B21C 37/20 165/133
4,660,630 A * 4/1987 Cunningham ..... F28F 13/18 165/133
4,733,698 A * 3/1988 Sato ..... F28F 1/40 138/38
4,796,693 A 1/1989 Kastner et al.
5,054,548 A 10/1991 Zohler
5,186,252 A 2/1993 Nishizawa et al.
5,332,034 A * 7/1994 Chiang ..... F28F 1/40 165/184
5,458,191 A * 10/1995 Chiang ..... F28F 1/40 165/133
5,586,598 A * 12/1996 Tanaka ..... B21C 37/151 165/133
5,597,039 A 1/1997 Rieger
5,669,441 A 9/1997 Spencer
5,697,430 A 12/1997 Thors et al.
5,975,196 A * 11/1999 Gaffaney ..... F28F 1/40 165/133
6,067,832 A 5/2000 Brand et al.
6,182,743 B1 * 2/2001 Bennett ..... F28F 1/40 165/133
6,336,501 B1 * 1/2002 Ishikawa ..... F28F 1/40 165/133
6,488,078 B2 * 12/2002 Beutler ..... B21C 37/207 165/133
6,786,072 B2 9/2004 Beutler et al.
6,834,523 B2 * 12/2004 Hinago ..... B21B 17/10 72/206
7,178,361 B2 2/2007 Thors et al.
7,841,391 B2 * 11/2010 Hao ..... F28F 1/40 165/133
8,091,616 B2 * 1/2012 Lu ..... F28F 1/422 165/133
8,162,039 B2 * 4/2012 Cao ..... F28F 1/36 165/133
8,281,850 B2 10/2012 Beutler et al.
8,753,752 B2 * 6/2014 Fujii ..... B21C 37/02 428/600
8,857,505 B2 10/2014 Beutler et al.
9,188,287 B2 * 11/2015 Krautschick ..... F17D 1/08
9,234,709 B2 * 1/2016 Gotterbarm ..... B23P 15/26
9,909,819 B2 3/2018 Lutz et al.
9,945,618 B1 * 4/2018 Gorgy ..... F28F 3/048
2002/0070011 A1 * 6/2002 Itoh ..... F28F 1/40 165/133
2003/0009883 A1 * 1/2003 Thors ..... F28F 1/40 29/890.03
2004/0069467 A1 4/2004 Thors et al.
2005/0145377 A1 * 7/2005 Thors ..... B21D 31/00 165/133
2006/0112535 A1 * 6/2006 Thors ..... B21J 5/068 29/557
2006/0213346 A1 * 9/2006 Thors ..... B21C 37/158 83/178
2007/0124909 A1 * 6/2007 Thors ..... F28F 1/42 29/428
2007/0151715 A1 7/2007 Yunyu et al.
2007/0234871 A1 * 10/2007 Thors ..... F28F 1/422 83/875
2009/0178432 A1 * 7/2009 Reagen ..... F25B 39/02 62/347
2010/0193170 A1 * 8/2010 Beutler ..... B21C 37/207 165/181
2010/0193171 A1 * 8/2010 Beppu ..... C21D 8/08 165/181
2011/0036553 A1 * 2/2011 Christen ..... F28F 19/006 165/185
2016/0097604 A1 * 4/2016 Reagen ..... F28F 21/084 165/183
2016/0369377 A1 * 12/2016 Somani ..... C22C 21/00

FOREIGN PATENT DOCUMENTS

DE 197 57 526 C1 4/1999
DE 10 2006 008 008 083 B4 9/2007
DE 603 17 506 T2 9/2008
DE 102011121733 A1 * 6/2013 ..... F28F 13/187
EP 0 222 100 B1 5/1987
EP 0 713 072 B1 5/1996
EP 1 223 400 B1 7/2002
EP 2 101 136 B1 9/2009
JP 04-039596 A 2/1992
WO WO 03/089865 A1 10/2003

OTHER PUBLICATIONS

Written Opinion of International Searching Authority issued in Application No. PCT/EP2017/000595 dated Oct. 18, 2017 (7 pages).
Office Action of German Patent Office issued in German Application No. 10 2016 006 914.7 dated Feb. 8, 2017 (4 pages).

* cited by examiner

HEAT EXCHANGER TUBE

TECHNICAL FIELD

The invention relates to a metallic heat exchanger tube having a longitudinal tube axis with a tube wall, an outer tube face, an inner tube face, axially parallel or helically circumferential continuous fins formed from the tube wall on the outer tube face and/or inner tube face, continuously extending primary grooves formed between respectively adjacent fins, the fins having at least one structured region on the outer tube face and/or inner tube face, the structured region having a multiplicity of projections separated by notch formations.

BACKGROUND AND SUMMARY

Such metallic heat exchanger tubes serve, in particular, for evaporating fluids from pure substances or mixtures on the outer tube face.

Evaporation occurs in many fields of refrigeration and air-conditioning technology as well as in processing and energy technology. Tubular bundle heat exchangers in which fluids evaporate from pure materials or mixtures on the outer tube face and in the process cool brine or water on the inner tube face are frequently used. Such apparatuses are referred to as flooded evaporators.

The size of the evaporators can be reduced greatly by making the transfer of heat on the outer tube face and the inner tube face more intensive. As a result, the manufacturing costs of such apparatuses are lowered. Moreover, the necessary filling quantity of refrigerant drops, which can make up a considerable portion of the cost of the entire system with the chlorine-free safety refrigerants which are predominantly used nowadays. In the case of toxic or combustible refrigerants, the potential hazard can also be reduced by decreasing the filling quantity. The high-performance tubes which are customary nowadays are already more efficient by a factor of four than smooth tubes of the same diameter.

It is state-of-the-art to manufacture such efficient tubes on the basis of integrally rolled fin tubes. Integrally rolled fin tubes are understood to be finned tubes in which the fins have been formed from the material of the wall of a smooth tube. In this context, various methods are known with which the channels which are located between adjacent fins are closed in such way that connections remain between the channel and the surroundings in the form of pores or slits. As is already known from numerous documents, such essentially closed channels are produced by bending over or folding over the fins (U.S. Pat. Nos. 3,696,861; 5,054,548; 7,178,361 B2), by splitting and compressing the fins (DE 2 758 526 C2; U.S. Pat. No. 4,577,381) and by notching and compressing the fins (U.S. Pat. No. 4,660,630; EP 0 713 072 B1; U.S. Pat. No. 4,216,826).

The most high-performance, commercially available fin tubes for flooded evaporators have, on the outer tube face, a fin structure with a fin density of 55 to 60 fins per inch (U.S. Pat. Nos. 5,669,441; 5,697,430; DE 197 57 526 C1). This corresponds to a fin pitch of 0.45 to 0.40 mm. In principle it is possible to improve the performance of such tubes by means of a relatively high fin density or relatively low fin pitch, since this increases the bubble nucleation density. A relatively low fin pitch inevitably requires equally finer tools. However, finer tools are subject to a greater risk of breakage and to faster wear. The currently available tools permit safe fabrication of fin tubes with fin densities of at maximum 60 fins per inch. In addition, as the fin pitch decreases the production speed of the tubes becomes lower and consequently the manufacturing costs higher.

Furthermore, it is known that higher-performance evaporation structures with a constant fin density on the outer tube side can be produced by introducing additional structure elements between the fins in the region of the groove base. Since the temperature of the fin is higher in the region of the groove base than in the region of the fin tip, structure elements are absolutely effective for making the bubble formation more intensive in this region. Examples of this can be found in EP 0 222 100 B1; U.S. Pat. No. 5,186,252; JP 04039596A and US 2007/0151715 A1. These inventions have in common the fact that the structure elements of the groove base do not have an undercut shape, for which reason they do increase the intensity of the bubble formation sufficiently. In EP 1 223 400 B1 and EP 2 101 136 B1 it is proposed that undercut secondary grooves be produced at the groove base between the fins, which secondary grooves extend continuously along the primary groove. The cross-section of these secondary grooves can remain constant or be varied at regular intervals.

The invention is based on the object of specifying a higher-performance heat exchanger tube for evaporating fluids.

The object is achieved with a heat exchanger tube as described below.

The invention includes a heat exchanger tube having a longitudinal tube axis, wherein axially parallel or helically circumferential continuous fins are formed from the tube wall on the outer tube face and/or inner tube face, continuously extending primary grooves are formed between respectively adjacent fins, the fins have at least one structured region on the outer tube face and/or inner tube face, and the structured region has a multiplicity of projections which project from the surface with a projection height, wherein the projections are separated by notch formations. According to the invention, a plurality of projections are shaped with respect to one another in pairs in such a way that cavities are formed between adjacent projections.

Furthermore, the invention includes a heat exchanger tube having a longitudinal tube axis, wherein axially parallel or helically circumferential continuous fins are formed from the tube wall on the outer tube face and/or inner tube face, continuously extending primary grooves are formed between respectively adjacent fins, the fins have at least one structured region on the outer tube face and/or inner tube face, and the structured region has a multiplicity of projections which project from the surface with a projection height, wherein the projections are separated by notch formations. According to the invention, a plurality of projections are shaped in the direction of the tube wall, with the result that cavities are formed between a respective projection and the tube wall.

In the solutions according to the invention, the structured region can in principle be formed on the outer tube face or the inner tube face. However, it is preferred to arrange the fin sections according to the invention in the interior of the tube. The described structures can be used both for evaporator tubes and for condenser tubes. The structures are equally suitable for single-phase fluid flows, such as for example water.

A cavity in the case of adjacent projections is present when the respectively shortest distance between adjacent projections starting from the tube wall as far as the location on the projections which is furthest away from the tube wall is reduced. In other words: The adjacent projections which form a cavity are inclined toward one another.

In other words: The cavity is formed with the concave faces, respectively located opposite one another, of adjacent projections. The surfaces of the adjacent projections which form a cavity therefore extend over said cavity in an arch-like fashion.

The projection height is expediently defined as the dimension of a projection in the radial direction. The projection height is then the distance starting from the tube wall as far as the location on the projection which is furthest away from the tube wall in the radial direction.

The notch depth of the notch formations is the distance measured in the radial direction starting from the original fin tip as far as the deepest point of the notch. In other words: The notch depth is the difference between the original fin height and the residual fin height remaining at the deepest point of a notch.

The invention is based here on the idea that the cavities according to the invention are formed by the hollow spaces which are produced between the tube wall and the folded-over projections or between adjacent projections. In order to produce the cavities, the projections are cut and folded up or folded over so that they form such cavities. In this context, there are different embodiments in which the projections are in contact with the tube wall or also form cavities without direct contact. The manufacture can take place directly via adapted cutting geometries or by means of a secondary shaping process, wherein the secondary tool which is used smooth or can have an additional structure.

In principle, during the evaporation, the tubes can be arranged horizontally or vertically on the inner tube face for example. In addition, there are cases in which the tubes are inclined slightly with respect to the horizontal or the vertical. In refrigeration technology, evaporators with horizontal tubes are usually used. In contrast, in chemical engineering, vertical circulation evaporators are frequently used to heat distillation columns. The evaporation of the substance takes place here on the inner face of vertical tubes.

In order to permit the heat transfer between the medium which outputs heat and the evaporating substance, the temperature of the medium which outputs heat must be higher than the saturation temperature of the substance. This temperature difference is referred to as the driving temperature difference. The higher the driving temperature difference, the more heat can be transferred. On the other hand, the aim is mostly to keep the driving temperature difference low, since this is advantageous for the process efficiency.

The cavities according to the invention make the process of the nucleate boiling more intensive in order to increase the heat transfer coefficients during the evaporation. The formation of bubbles starts at nuclei. These nuclei are usually small pockets of gas or vapor. When the growing bubble has reached a certain size, it becomes detached from the surface. If the nucleus is flooded with fluid in the course of the detachment of the bubble, the nucleus is deactivated. The surface must therefore be configured as a cavity in such a way that when the bubble becomes detached a small bubble is retained, which then serves as a nucleus for a new cycle of bubble formation. This is achieved in that cavities in which a small bubble can remain after the bubble has become detached are arranged on the surface.

In one preferred refinement of the invention, the tips of at least two projections can be in contact with one another or cross over one another along the fin profile. This is advantageous specifically during the phase change in the reversible operating mode since the projections project far out of the condensate for the liquefaction and form a type of cavity for the evaporation.

The tips of at least two projections can advantageously be in contact with one another or cross over one another over the primary groove. This is in turn advantageous during the phase change in the reversible operating mode since the projections project far out of the condensate for the liquefaction and form a type of cavity for the evaporation.

In contrast, it is also possible for the distance between the tip of the projection and the tube wall to be less than the residual fin height. As a result, the projection is given a hook-like or eyelet-like shape directly over the tube wall. Such rounded shapes are particularly advantageous for bubble nucleation during evaporation processes.

In one advantageous embodiment of the invention, at least one of the projections can be shaped in such a way that its tip is in contact with the inner tube face. As a result, a bubble nucleus is formed near to the tube wall as a result of an, in turn, hook-like or eyelet-like shape of the projection at the phase change of a fluid heat transfer medium. A particularly intensive transfer of heat into the fluid takes place via the tube wall there.

In one preferred refinement of the invention, the notch formations can be formed between primary grooves by cutting the inner fins at a cutting depth transversely with respect to the fin profile to form fin layers and by raising the fin layers in a main orientation along the fin profile.

The method-related structuring of the heat transfer tube according to the invention can be brought about by using a tool which is already described in DE 603 17 506 T2. The disclosure of this document DE 603 17 506 T2 is included fully in the present documents. As a result, the projection height and the distance can be configured variably and adapted individually with respect to the requirements, for example the viscosity of the liquid or the flow rate.

The tool which is used has a cutting edge for cutting through the fins on the inner surface of the tube in order to produce fin layers and a lifting edge for lifting the fin layers to form the projections. In this way, the projections are formed without removing metal from the inner surface of the tube. The projections on the inner surface of the tube can be formed in the same processing step or a different processing step to the formation of the fins.

As a result, the projection height and distance can be configured in a variable fashion and adapted individually to the requirements of the fluid in question, for example in terms of the viscosity of the fluid and the flow rate.

The projections can advantageously vary with respect to one another in terms of projection height, shape and orientation. As a result, the individual projections can be adapted selectively and can vary with respect to one another so that therefore, particularly in the case of laminar flow, they dip, as a result of different fin heights, into the different boundary layers of the flow in order to divert the heat to the tube wall. The projection height and the spacing can therefore also be individually adapted to the requirements, e.g. the viscosity of the fluid or the flow rate etc.

In a preferred refinement of the invention, a projection can have a tip, running to a point, at the face facing away from the tube wall. This brings about optimized condensation at the projection tip in the case of condenser tubes using two-phase fluids.

In one particularly preferred embodiment, a projection has, on the face facing away from the tube wall, a curved tip whose local curvature radius is decreased starting from the tube wall as the distance increases along the projection profile. This has the advantage that in particular in the case of condensation, the condensate which is produced at the tip is transported more quickly to the fin foot as a result of the convex curvature, and the transfer of heat is therefore optimized when liquefaction occurs. At the phase change, here specifically when liquefaction occurs, the emphasis is on the liquefaction of the vapor and the conduction away of the condensate from the tip to the fin foot. A convexly curved projection forms an ideal basis for the effective transfer of heat for this. The basis of the projection protrudes essentially radially from the tube wall here. Identical or similar structure elements can therefore be equally suitable both for an evaporator tube and for a condenser tube.

Exemplary embodiments of the invention are explained in more detail below with reference to the schematic drawings.

BRIEF DESCRIPTION OF THE DRAWINGS

In the drawings.

Mutually corresponding parts are provided in all figures with the same reference signs.

DETAILED DESCRIPTION

Figure 1:
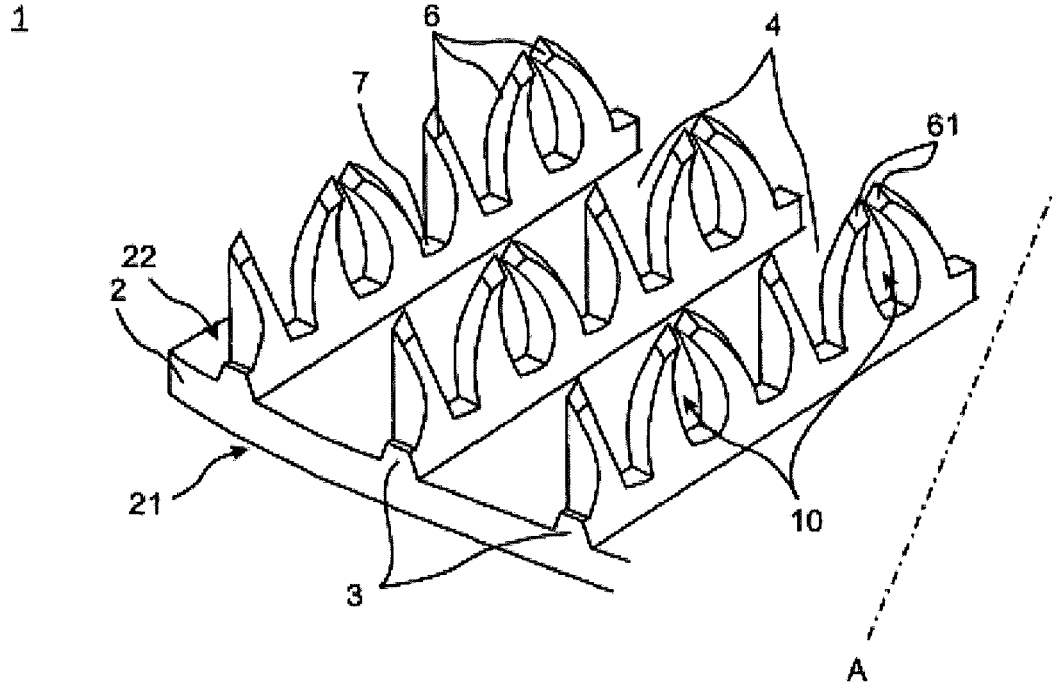
FIG. 1 is a schematic, oblique view of a tube detail of the heat exchanger tube with an inventive structure on the inner tube face.

FIG. 1 is a schematic, oblique view of a tube detail of the heat exchanger tube 1 with an inventive structure on the inner tube face 22. The heat exchanger tube 1 has a tube wall 2, an outer tube face 21 and an inner tube face 22. Helically circumferential continuous fins 3 are formed from the tube wall 2 on the inner tube face 22. The longitudinal tube axis A runs at a certain angle with respect to the fins 3. Continuously extending primary grooves 4 are formed between respectively adjacent fins 3.

A plurality of projections 6 are shaped with respect to one another in pairs in such a way that cavities 10 are formed between adjacent projections 6. In this context, the tips 61 of at least two projections 6 are in contact with one another along the fin profile.

The projections 6 are formed between primary grooves 4 by cutting the fins 3 at a cutting depth transversely with respect to the fin profile to form fin layers and by raising the fin layers in a main orientation along the fin profile. The notch formations 7 between the projections 6 can also be formed with a changing notch depth in one fin 3.

Figure 2:
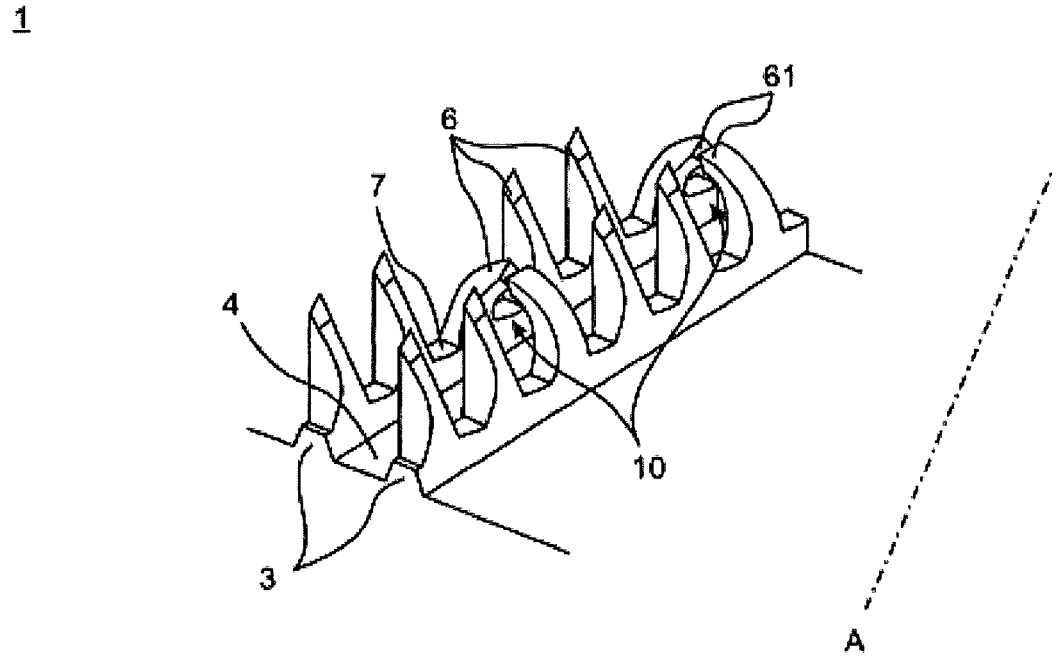
FIG. 2 is a schematic, oblique view of a tube detail of the heat exchanger tube with a further inventive structure.

FIG. 2 shows a schematic, oblique view of a tube detail of the heat exchanger tube 1 with a further inventive structure. A plurality of projections 6 are shaped with respect to one another in pairs in such a way that cavities are formed between adjacent projections 6. In this context, the tips 61 of at least two projections 6 extend over the primary groove 4 and are in contact with one another. However, the tips 61 of projections 6 which are shaped with respect to one another in pairs can also be at a certain distance from one another. However, this distance is so small that effective cavities 10 are still formed.

The projections 6 are in turn formed between primary grooves 4 by cutting the fins 3 at a cutting depth transversely with respect to the fin profile to form fin layers and by raising the fin layers in a main orientation along the fin profile. The notch formations 7 between the projections 6 can also be formed with a changing notch depth in one fin 3.

Figure 3:
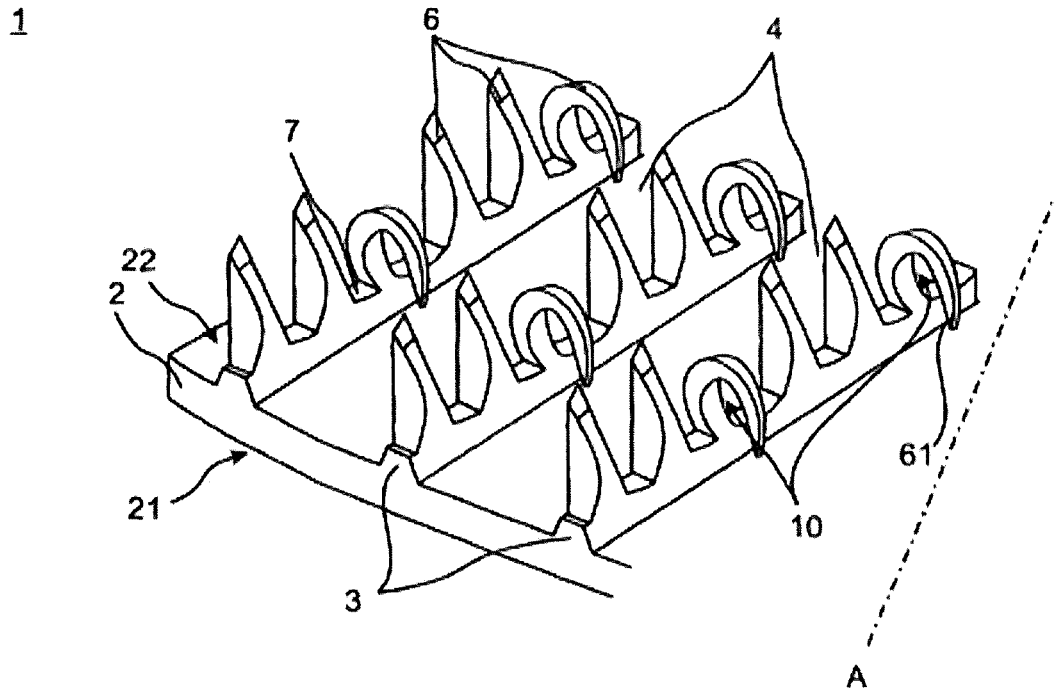
FIG. 3 is a schematic, oblique view of a tube detail of the heat exchanger tube with a further inventive structure on the inner tube face.

FIG. 3 shows a schematic, oblique view of a tube detail of the heat exchanger tube 1 with a further inventive structure on the inner tube face 22. A plurality of projections 6 are shaped in the direction of the tube wall 2, with the result that cavities 10 are formed between a respective projection and the tube wall 2.

In this context, the distance between the tips 61 of a projection and the tube wall is shorter than the residual fin height. Consequently a hook-like shape is produced. However, a projection 6 can be shaped in such a way that its tip 61 is in contact with the inner tube side 22. In this case which is not illustrated in FIG. 3, an eyelet-like shape is preferably produced. The projections 6 are in turn formed by cutting the fins 3 in a way analogous to FIGS. 1 and 2.

Figure 4:
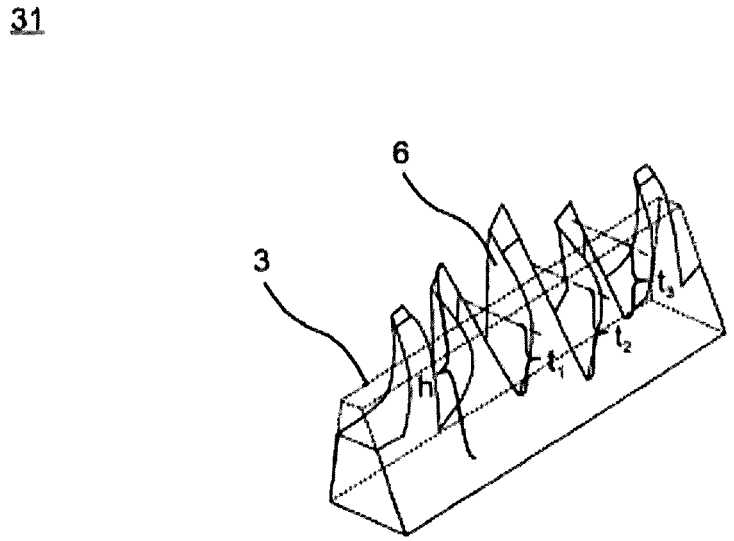
FIG. 4 shows a schematic view of a fin section with a different notch depth.

FIG. 4 shows a schematic view of a fin section 31 with a different notch depth $t_1$, $t_2$, $t_3$. The terms cutting depth and notch depth express the same concept within the scope of the invention. The projections 6 have alternately changing notch depths $t_1$, $t_2$, $t_3$ by means of a fin 3. The original, shaped helically circumferential fin 3 is indicated by dashed lines in FIG. 4. The projections 6 are formed from said fin 3 by cutting the fin 3 at a notch/cutting depth $t_1$, $t_2$, $t_3$ transversely with respect to the fin profile to form fin layers and by raising the fin layers in a main orientation along the fin profile. The different notch/cutting depths $t_1$, $t_2$, $t_3$ are consequently measured at the notch depth of the original fin in the radial direction.

The projection height h is expediently defined in FIG. 2 as the dimension of a projection in the radial direction. The projection height h is then the distance starting from the tube wall as far as the point on the projection which is furthest away from the tube wall in the radial direction.

The notch depth $t_1$, $t_2$, $t_3$ is the distance measured in the radial direction starting from the original fin tip as far as the deepest point of the notch. In other words: The notch depth is the difference between the original fin height and the residual fin height remaining at the deepest point of a notch.

Figure 5:
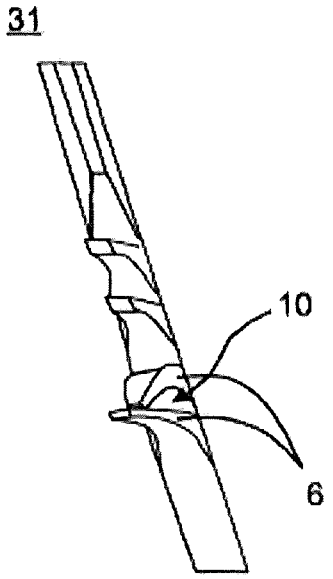
FIG. 5 shows a schematic view of a fin section with two projections which are in contact with one another along the fin profile.
Figure 6:
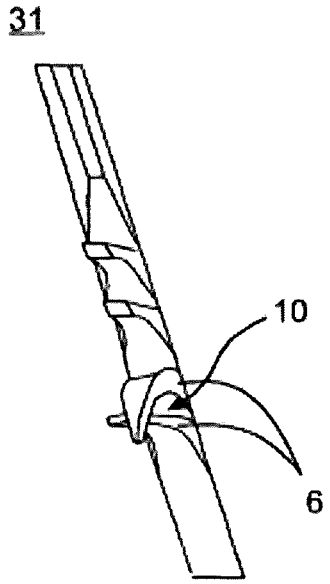
FIG. 6 shows a schematic view of a fin section with two projections which cross over one another along the fin profile.
Figure 7:
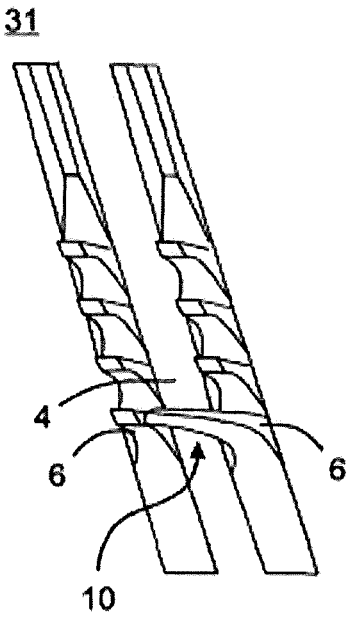
FIG. 7 shows a schematic view of a fin section with two projections which are in contact with one another over the primary groove.
Figure 8:
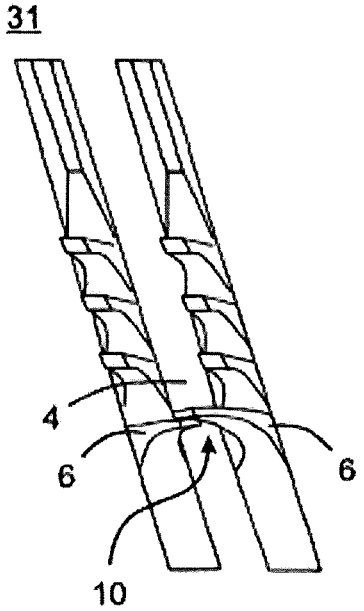
FIG. 8 shows a schematic view of a fin section with two projections which cross over one another over the primary groove.

FIG. 5 shows a schematic view of a fin section 31 with two projections 6 which are in contact with one another along the fin profile. Furthermore, FIG. 6 shows a schematic view of a fin section 31 with two projections 6 which cross over one another along the fin profile. FIG. 7 also shows a schematic view of a fin section 31 with two projections 6 which are in contact with one another over the primary groove. FIG. 8 shows a schematic view of a fin section 31 with two projections 6 which cross over one another over the primary groove.

With the structure elements illustrated in FIGS. 5 to 8, it is advantageous, specifically in the reversible operating mode with two-phase fluids, that they form a type of cavity 10 for the evaporation. The cavities 10 of this particular type form the starting points for bubble nuclei of an evaporating fluid.

The invention claimed is:

1. A heat exchanger tube having a longitudinal tube axis, the heat exchanger tube comprising:

a tube wall, an outer tube face and an inner tube face;

axially parallel or helically circumferential continuous fins formed from the tube wall on at least one of the outer tube face or the inner tube face;

continuously extending primary grooves formed between respectively adjacent fins;

the fins having at least one structured region on the at least one outer tube face or inner tube face;

the structured region having a multiplicity of projections which project from the at least one outer tube face or inner tube face with a projection height, wherein the projections are separated by notch formations and wherein each projection has a tip;

a plurality of the projections being shaped with respect to each other in pairs such that cavities are formed between adjacent projections, the tips of two of the projections disposed adjacent one another along the same fin are in contact with one another and are a first pair of contacting projections, and the tips of two of the projections disposed adjacent one another along the same fin are in contact with one another and are a second pair of contacting projections, the first and second pairs of contacting projections being disposed along the same fin, and at least one stand-alone projection is disposed between, and on the same fin as, the first and second pairs of contacting projections.

2. The heat exchanger tube as claimed in claim 1, wherein the notch formations are formed between the primary grooves by cutting the fins at a cutting depth transversely with respect to a longitudinal extent of the fin to form fin layers and by raising the fin layers in a main orientation along the longitudinal extent of the fin.

3. The heat exchanger tube as claimed in claim 1, wherein the projections vary with respect to one another in projection height, shape and orientation.

4. The heat exchanger tube as claimed in claim 1, wherein at least one of the projections has a face facing away from the tube wall and the tip of the at least one projection runs to a point at the face.

5. The heat exchanger tube as claimed in claim 1, wherein at least one of the projections has a face facing away from the tube wall and the tip of the at least one projection is curved on the face, the curved tip having a local curvature radius which decreases starting from the tube wall as a distance from the tube wall increases along the at least one projection.

6. The heat exchanger tube as claimed in claim 1, wherein the two projections of each of the first and second pairs of contacting projections each have a concave face, the concave faces of the two projections of the first and second pairs of contacting projections facing one another and defining the respective cavity therebetween.

7. A heat exchanger tube having a longitudinal tube axis, the heat exchanger tube comprising:

a tube wall, an outer tube face and an inner tube face facing away from the outer tube face;

a plurality of elongate fins formed from the tube wall and extending continuously along at least one of the outer tube face or the inner tube face; and a plurality of elongate grooves extending continuously along the tube wall, each groove extending between two adjacent fins;

each fin having at least one structured region, the structured region including a plurality of projections disposed one after another along a longitudinal extent of the fin and separated from one another by respective notch formations, the projections extending outwardly from the at least one outer tube face or inner tube face such that each of the projections has a projection height, first and second pairs of the projections disposed along the same fin each including two projections disposed immediately adjacent one another and shaped to form a cavity therebetween, the projections of the first pair of projections disposed along the same fin have respective tips disposed in contact with one another, the projections of the second pair of projections disposed along the same fin have respective tips disposed in contact with one another, and at least one stand-alone projection is disposed between, and on the same fin as, the first and second pairs of projections.

8. The heat exchanger tube as claimed in claim 7, wherein the projections of the first and second pairs of projections have respective concave faces which face one another and define the respective cavity therebetween.

* * * * *